US007537559B2

(12) United States Patent
Wieking et al.

(10) Patent No.: US 7,537,559 B2
(45) Date of Patent: May 26, 2009

(54) SELF-DUMPING SEPARATOR WITH A DISK STACK AND FINS ARRANGED RADIALLY OUTSIDE THE DISC STACK

(75) Inventors: Wolfgang Wieking, Oelde (DE); Siegfried Klapper, Herrzebrock-Clarholz (DE); Bernhard Heymann, Bönen (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 11/683,043

(22) Filed: Mar. 7, 2007

(65) Prior Publication Data

US 2007/0270298 A1 Nov. 22, 2007

(30) Foreign Application Priority Data

Sep. 4, 2004 (DE) ..... 10 2004 042 888
Jul. 13, 2005 (WO) ..... PCT/EP2005/007573

(51) Int. Cl.
*B04B 1/08* (2006.01)

(52) U.S. Cl. ..... 494/70; 494/79

(58) Field of Classification Search ..... 494/2–4, 494/40, 67–73, 74, 79, 27, 65
See application file for complete search history.

(56) References Cited

U.S. PATENT DOCUMENTS

| | | | | | |
|---|---|---|---|---|---|
| 1,422,852 | A * | 7/1922 | Hall | ..... | 494/57 |
| 1,482,229 | A * | 1/1924 | Hapgood | ..... | 494/13 |
| 2,126,864 | A | 8/1938 | Bath | | |
| 2,313,541 | A | 3/1943 | Flowers | | |
| 2,477,982 | A | 8/1949 | Hintz, Jr. | | |
| 2,504,261 | A | 4/1950 | Harstick | | |
| 3,192,149 | A * | 6/1965 | Keith, Jr. | ..... | 208/28 |
| 3,388,054 | A * | 6/1968 | Keith, Jr. | ..... | 208/33 |
| 3,529,767 | A * | 9/1970 | Keith, Jr. et al. | ..... | 494/27 |
| 3,534,903 | A * | 10/1970 | Keith, Jr. | ..... | 494/22 |
| 5,735,789 | A | 4/1998 | Borgstrom et al. | | |
| 2007/0270298 | A1 * | 11/2007 | Wieking et al. | ..... | 494/70 |

FOREIGN PATENT DOCUMENTS

| | | | |
|---|---|---|---|
| DE | 444573 | A1 | 10/1925 |
| DE | 567665 | A1 | 12/1932 |
| DE | 3409068 | A1 * | 9/1985 |
| DE | 19508334 | A1 * | 9/1996 |

* cited by examiner

*Primary Examiner*—Charles E Cooley
(74) *Attorney, Agent, or Firm*—Gauthier & Connors LLP

(57) ABSTRACT

A self-dumping separator having a vertical axis of rotation and having a drum (1) into which a disc stack (3) made up of a plurality of conical discs (4) is inserted, a centrifuge feed being introducible via an inlet pipe (6) and a distributor (7) into the centrifuge space (2), which is enclosed by the drum (1), at least two or more fins (17) being arranged in an annular solids space (15) that is arranged radially outside the disc stack (3), the clearance between the fins (17) and the inner wall of the drum (1) being at least three millimeters.

13 Claims, 4 Drawing Sheets

FIG..7
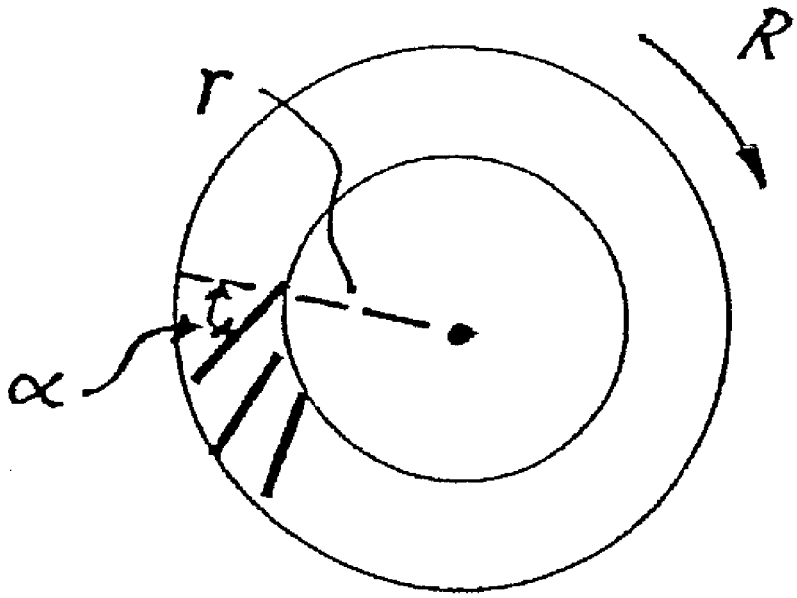
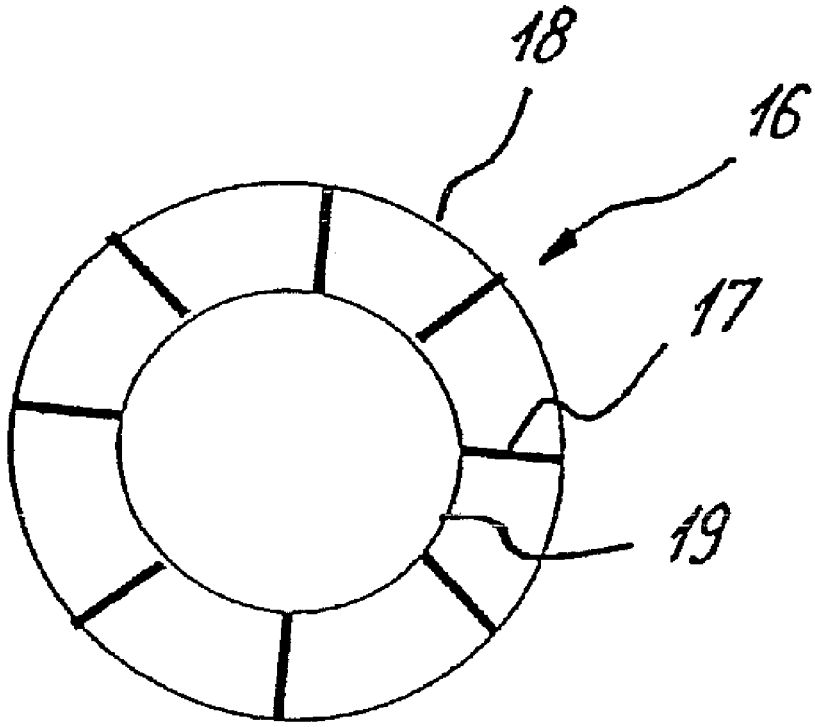
FIG..8

SELF-DUMPING SEPARATOR WITH A DISK STACK AND FINS ARRANGED RADIALLY OUTSIDE THE DISC STACK

PRIORITY INFORMATION

This application claims the benefit of International Patent Application Serial No. PCT/EP2005/007573 filed on Jul. 13, 2005 and claims priority to German Application Serial No. 10 2004 042 888.3, filed on Sep. 4, 2004.

BACKGROUND OF THE INVENTION

1. Field of the Invention

The invention relates to a self-dumping separator with a disc stack. The self-dumping separator has a vertical axis of rotation and a drum with solids discharge openings. A disc stack made up of a plurality of conical discs is inserted into the drums. A centrifuge feed is introduced via an inlet pipe and a distributor into a centrifuge space that is enclosed by the drum. At least two or a plurality of fins is arranged in an annular solids space that is arranged radially outside the disc stack.

Self-dumping separators having disc stacks, which exhibit for example a piston slide valve or the like for the purpose of dumping, are known in the most varied embodiments. They are employed for a wide range of purposes in various types of centrifuges, for example in clarifying, separatory, or degerminating centrifuges. The preferred area of application here is the processing of dairy products and here, in particular, the degermination and separation of milk.

It is also known to provide self-dumping centrifuge drums with fins outside the disc stack. Such an arrangement is shown for example in U.S. Pat. No. 2,126,864, which shows a separator having a drum with solids discharge openings that are closable by a piston slide valve.

In self-dumping separators usual at present, cleaning problems arise under some circumstances in practice. It turns out that the cleaning effect on the drum cover and on the bottom of the centrifuge space in the drum is especially problematic and that contaminants can frequently be found there even after automatic cleaning.

2. Brief Description of the Art

Against this background, it is an object of the invention to improve the design and construction of the separator of the type stated at the outset in such fashion that an improved cleaning action can be attained.

According to the invention, the drum exhibits solids discharge openings and the clearance between the fins—or the advantageously implemented fin insert—and the inner wall of the drum at every point is at least three millimeters.

In this way the clearance between the fins and the inner shell of the drum is made so large that at every point in the solids space the clearances between the fins and the inner shell of the drum, in particular the drum cover and the bottom of the centrifuge space as well as, advantageously, at other points critical in respect of cleaning, are large enough that adequately great relative motion of the liquid relative to the drum in the circumferential direction is always permitted at the outer circumferential surface and in other marginal regions of the centrifuge space.

From U.S. Pat. No. 3,529,767 there is known a design having fins in a separator drum, individual ones of the fins (e.g., fins 51"), however, lying directly against the drum shell.

With regard to the existing art, the following are further cited: DE 567 665, DE 444,573, U.S. Pat. No. 2,662,687 and U.S. Pat. No. 2,313,541. These publications each show chamber separators having fin inserts outside the disc stack but no solids discharge openings, so that the advantages according to the invention cannot come about. U.S. Pat. No. 2,477,982 shows a self-dumping separator having discharge openings with no piston slide valve, fins outside the disc stack again extending to the drum cover. U.S. Pat. No. 5,735,789 shows a separator having a disc stack with fin-shaped spacers.

SUMMARY OF THE INVENTION

Advantageous developments and embodiments of the invention are to be inferred from the dependent claims.

An annular gap of at least 0.5 mm but maximally 5 mm is preferably fashioned between the fins and the disc stack in order also to clean this region adequately.

According to a further embodiment of the invention, it is advantageous if the fins cover at least 5 percent but maximally 95 percent of the cross-sectional area of the solids space, in order always to ensure an adequate cleaning action.

In a layout as a separatory separator, it is further advantageous according to the knowledge of the invention if the outside diameter of the fins is larger than the diameter of the splitter disc by at least 1 mm but maximally 25 mm.

Here the center of gravity of the fin surface should advantageously lie above the dumping plane. Alternatively, however, it is also conceivable to arrange this center of gravity below the dumping plane, which however leads to less-advantageous results.

According to a further advantageous development of the invention, the fin surfaces are provided with equalizing openings. These advantageously relieve the fins of peak Coriolis pressure loads during drum dumpings.

It is further advantageous to position the fins so that their surfaces are each oriented leadingly or laggingly at an angle of up to 45° relative to the radius of the drum.

In development of the invention, it is furthermore conceivable to insert three-dimensionally curved vanes instead of planar fins. Finally, it has turned out that at least two but preferably 8 to 24 fins should be distributed, in particular uniformly, on the outer circumference of the disc stack.

The fins are advantageously combined by connecting elements into a ring-shaped insert, which facilitates assembly and disassembly of the fins as a unit. This fin insert is furthermore advantageously fixed in place by brace elements that are integrated into the disc stack.

Additionally, the fin insert is advantageously solidly connected to the splitter disc—if present—for the purpose of fixation.

BRIEF DESCRIPTION OF THE DRAWINGS

In what follows, the invention is described in greater detail on the basis of preferred exemplary embodiments with reference to the drawings, in which:

FIG. 7 is a schematic depiction of the fashioning of fins according to a particular exemplary embodiment of the invention;

FIG. 8 is a schematic depiction of a fin insert in a top view.

DETAILED DESCRIPTION OF THE INVENTION

Figure 1:
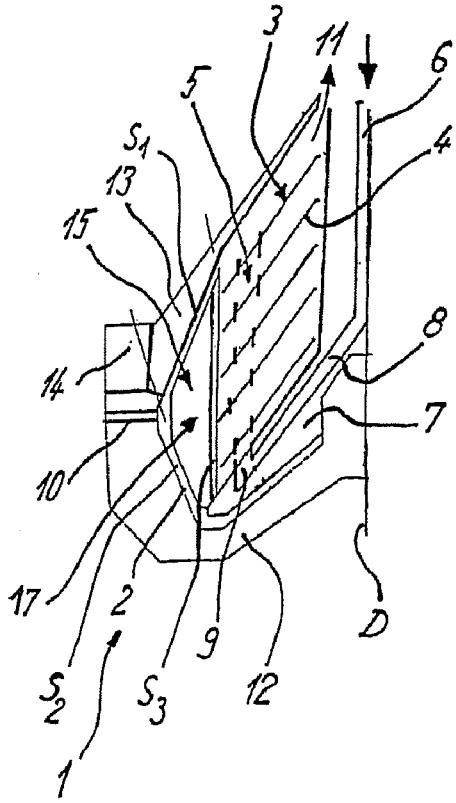
FIGS. 1 to 6 are schematic sectional views of a partial region of a separator drum according to the invention.

FIG. 1 shows a drum 1, depicted in highly schematic form, for a separator having a vertical axis of rotation D, the separator not being further illustrated with respect to its other components such as the drive and the like, the drum enclosing a centrifuge space 2 into which a disc stack 3 made up of a plurality of conical discs 4 is inserted, one or a plurality of ascending channels 5 being fashioned in the conical discs.

Here it should be remarked that terms such as "up," "down," "forward" or "rear" and the like relate solely to the schematic exemplary embodiments depicted and should not be understood as restrictive. Thus, in alternative embodiment not depicted here, the inlet pipe can also be led into the drum from below, even though what is depicted in FIG. 1 is a variant in which the inlet pipe is led into the drum from above.

From here, central inlet pipe 6 initially opens from above into a distributor 7, which exhibits channels 8 that convey the centrifuge feed outwardly into centrifuge space 2 up to discharge openings 9.

Discharge openings 9 can be arranged at various radii, preferably at radii such as lie a short distance before or within or after or outside the outer circumference of discs 4.

The drum exhibits solids discharge openings 10, which preferably lie at the largest diameter of the drum and ahead of which there is preferably connected a piston slide valve (not depicted here). A piston slide valve, not depicted here, can for example serve for implementing the self-dumping function or for opening and closing solids discharge openings 10.

At least one drain channel 11, behind which a shell disc can be connected, makes it possible to drain a liquid phase from centrifuge space 2.

Figure 2:
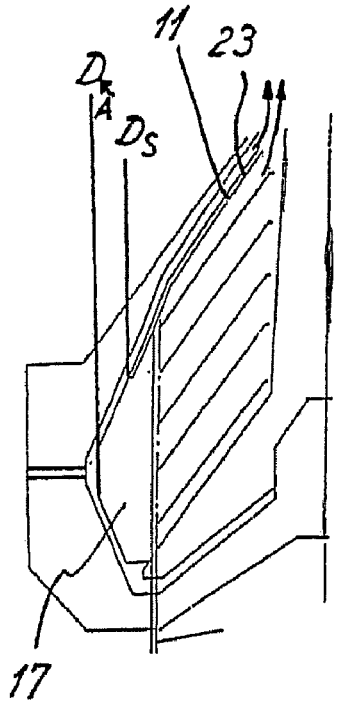

According to the exemplary embodiment of FIG. 2, which is depicted in simplified form so that the inlet pipe and the channels and discharge openings of the distributor are not depicted, it is also possible to drain a second liquid phase from the drum via a splitter disc 23 (outside diameter $D_S$).

Drum 1 exhibits a lower drum half 12 and an upper drum half 13, which are solidly connected to each other via a closure ring 14 or the like.

Outside the disc stack, in radially outwardly narrowing annular space or solids space 15, there is arranged a fin insert 16 (see FIG. 8) having a plurality of fins 17, fins 17 being combined into insert 16 by connecting elements 18, 19.

The insert can be fixed in place by brace elements that are integrated into the disc stack (not depicted here). The insert is also spaced at least 3 mm away from the inner wall of the drum at every point.

Alternatively, it is also conceivable to connect fin insert 16 solidly to splitter disc 23 of FIG. 2 for the purpose of fixation.

It is important that fin insert 16 be solidly fixed in place in solids space 15.

As can be seen in FIG. 7, the fins can be directed radially outwardly or, however, can be oriented leadingly or laggingly relative to the direction of rotation (R), in particular inclined at an angle ($\alpha$) of up to 45° relative to radial r.

It is now important that a gap S1, S2 remains at the outer edges of fins 17 and the lower drum half 12 or upper drum half 13, respectively, which gap is at least 3 mm wide or wider all the way around each fin. Preferably there is also a further annular gap S3 at least 0.5 mm and maximally 5 mm wide between the fins and the disc stack.

In this way an especially advantageous cleaning action is achieved, because it is ensured that there is always an adequately great cleaning action in solids space 15, since at all points there is always an adequately large flow between fins 17 and drum 1 at critical points, and in particular an adequately great relative motion of the liquid relative to the drum in the circumferential direction is permitted at the outer circumferential surfaces in all marginal regions of the centrifuge space.

FIG. 1 shows a variant in which fins 17 cover a majority of the cross section of the solids space, in particular up to 95 percent of the cross section of solids space 15.

In contrast, the cross section of fins 17 in FIG. 2 is somewhat smaller, supplementary splitter disc 23 also being present in FIG. 2. Outside diameter $D_A$ of the fins is larger than diameter $D_S$ of splitter disc 23 by at least 2 mm and maximally 25 mm.

Figure 3:
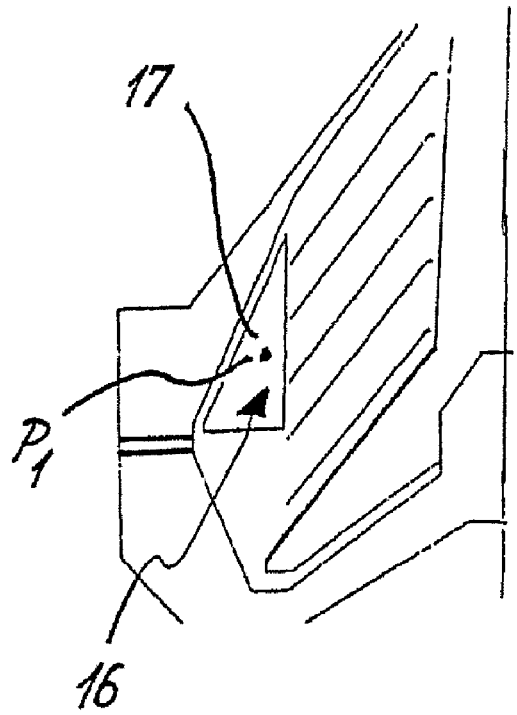

FIG. 3 makes it clear that center of gravity P1 of the fin surfaces lies above their plane of action, which is determined by solids discharge opening 10.

Figure 4:
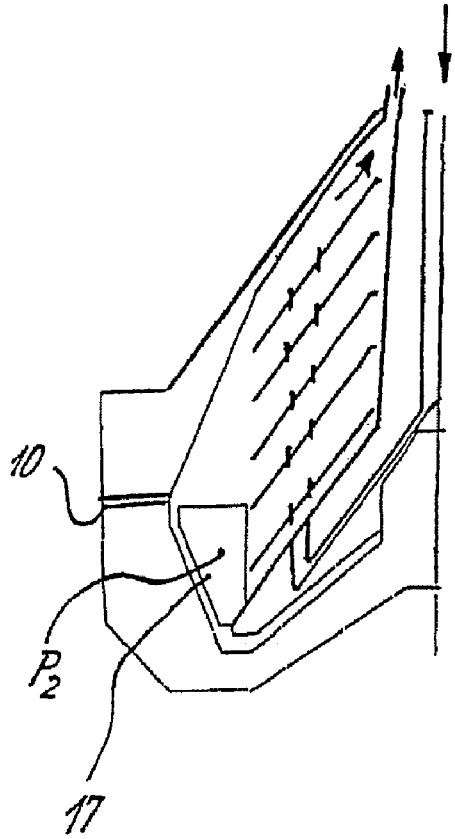

FIG. 4 displays a corresponding variant in which this center of gravity P2 of the fins is arranged below the plane of solids discharge opening 10.

Figure 5:
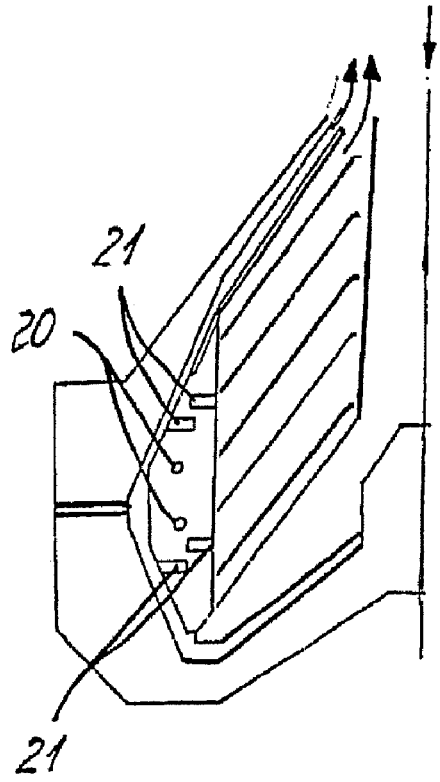

FIG. 5 shows further connecting elements (e.g., rings) 20, 21 for connecting fins 17 to one another.

Figure 6:
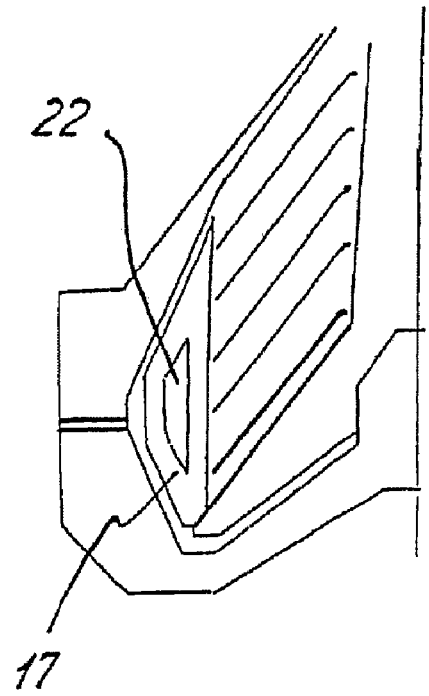

FIG. 6 shows that the fins can be provided with openings 22 in order to relieve the fin surfaces of fins 17 from peak Coriolis pressure loads at the solids discharge.

What we now claim is:

1. A self-dumping separator having a vertical axis of rotation and having a drum with solids discharge openings, into which drum a disc stack made up of a plurality of conical discs is inserted, said discharge openings are disposed at the largest diameter of the drum, a centrifuge feed being introducible via an inlet pipe and a distributor into a centrifuge space that is enclosed by the drum, at least two or a plurality of fins being arranged in an annular solids space that is arranged radially outside the disc stack, such that the clearance between the fins and the inner wall of the drum is at least three millimeters, wherein a splitter disc is arranged in the drum and in that the diameter ($D_A$) of the fins is greater than the diameter ($D_S$) of the splitter disc above the disc stack by at least 2 mm but maximally 25 mm, and the fins are combined into a ring-shaped preassembled insert by connecting elements.

2. The separator according to claim 1, wherein between the fins and the disc stack there is an annular gap that is at least 0.5 mm and maximally 5 mm wide at every point.

3. The separator according to claim 1, wherein the fins cover at least 5 percent and maximally 95 percent of the cross-sectional area of the solids space.

4. The separator according to claim 1, wherein the center of gravity (P1) of the fin surfaces of the fins lies above the dumping plane, which is specified by solids discharge openings.

5. The separator according to claim 1, wherein the center of gravity (P2) of the fin surfaces of the fins lies below the dumping plane, which is specified by the solids discharge openings of the drum.

6. The separator according to claim 1, wherein the fins exhibit at least one or a plurality of openings in their fin surface.

7. The separator according to claim 1, wherein the fins are oriented radially.

8. The separator according to claim 1, wherein the fins (17) are oriented leadingly or laggingly relative to the radius of the drum by up to 45°.

9. The separator according to claim 1, wherein the fins are fashioned as planar.

10. The separator according to claim 1, wherein the fins are fashioned as multidimensionally curved vanes.

11. The separator according to claim 1, wherein 8 to 24 of the fins are inserted into the drum.

12. The separator according to claim 1, wherein an insert is fixed in place by brace elements that are integrated into the disc stack.

13. The separator according to claim 1, wherein an insert is solidly connected to an splitter disc for the purpose of fixation.

* * * * *